US009371716B2

(12) United States Patent
Kim et al.

(10) Patent No.: US 9,371,716 B2
(45) Date of Patent: Jun. 21, 2016

(54) SELF-EXTENDABLE HYDRAULIC WELLBORE CLEANING TOOL

(71) Applicants: Namhyo Kim, Houston, TX (US); Antonio Lazo, Houston, TX (US); Earl B. Claiborne, Jr., Kemah, TX (US); Dexter G. Pazziuagan, Katy, TX (US)

(72) Inventors: Namhyo Kim, Houston, TX (US); Antonio Lazo, Houston, TX (US); Earl B. Claiborne, Jr., Kemah, TX (US); Dexter G. Pazziuagan, Katy, TX (US)

(73) Assignee: Chevron U.S.A. Inc., Houston, TX (US)

( * ) Notice: Subject to any disclaimer, the term of this patent is extended or adjusted under 35 U.S.C. 154(b) by 144 days.

(21) Appl. No.: 14/274,186

(22) Filed: May 9, 2014

(65) Prior Publication Data

US 2015/0322745 A1 Nov. 12, 2015

(51) Int. Cl.

| | |
|---|---|
| ***E21B 37/00*** | (2006.01) |
| ***E21B 37/02*** | (2006.01) |
| ***E21B 41/00*** | (2006.01) |
| ***B05B 3/06*** | (2006.01) |

(52) U.S. Cl.

CPC ..... *E21B 37/00* (2013.01); *B05B 3/063* (2013.01); *E21B 37/02* (2013.01); *E21B 41/0078* (2013.01)

(58) Field of Classification Search

CPC ... E21B 37/00; E21B 41/0078; E21B 43/292; B05B 3/063

USPC ..... 166/222, 223; 175/424

See application file for complete search history.

(56) References Cited

U.S. PATENT DOCUMENTS

| | | | | | |
|---|---|---|---|---|---|
| 1,980,942 | A * | 11/1934 | Manning | E21B 21/10 | 166/154 |
| 2,196,652 | A * | 4/1940 | Baker | E21B 33/146 | 166/156 |
| 2,228,640 | A * | 1/1941 | O'Neill | E21B 37/00 | 166/100 |
| 2,239,586 | A * | 4/1941 | Appleby | E21B 37/00 | 166/223 |
| 2,765,146 | A * | 10/1956 | Williams, Jr. | E21B 21/10 | 166/319 |
| 3,400,980 | A * | 9/1968 | Dahms | E21B 43/292 | 166/117 |
| 3,402,965 | A * | 9/1968 | Dahms | E21B 43/292 | 137/355.28 |
| 4,050,529 | A * | 9/1977 | Tagirov | E21B 43/112 | 166/100 |
| 4,967,841 | A * | 11/1990 | Murray | B08B 9/0433 | 134/22.12 |
| 5,086,842 | A * | 2/1992 | Cholet | B05B 1/267 | 134/167 C |
| 5,280,825 | A * | 1/1994 | Cholet | E21B 21/12 | 166/311 |
| 5,765,756 | A * | 6/1998 | Jordan | B05B 15/067 | 166/223 |
| 6,065,541 | A * | 5/2000 | Allen | E21B 23/04 | 166/222 |
| 6,196,319 | B1 * | 3/2001 | Henskens | E21B 27/00 | 166/163 |
| 7,051,821 | B2 * | 5/2006 | Samuel | E21B 17/006 | 166/223 |
| 7,434,633 | B2 * | 10/2008 | Lynde | E21B 29/005 | 166/55.8 |
| 9,139,457 | B2 * | 9/2015 | Hatten | C02F 1/008 | |
| 2003/0089505 | A1 * | 5/2003 | Pluchek | E21B 21/10 | 166/386 |
| 2009/0308595 | A1 * | 12/2009 | Hatten | B08B 9/0813 | 166/223 |
| 2010/0258299 | A1 * | 10/2010 | Hatten | B05B 3/063 | 166/223 |

* cited by examiner

*Primary Examiner* — Shane Bomar
(74) *Attorney, Agent, or Firm* — King & Spalding LLP

(57) ABSTRACT

The present disclosure provides techniques for a self-extendable hydraulic wellbore cleaning tool. The cleaning tool includes one or more extending nozzles which eject cleaning fluid onto the walls of a wellbore with increased impact momentum due to the shorter range. The extending nozzles can extend from the cleaning tool to a distance away from the cleaning tool, bringing the point of ejection closed to the walls of the wellbore. In certain example embodiments, the cleaning tool also includes one or more flow guides which direct the flow of cleaning fluid ejected from the nozzles. The flow guides cause the cleaning fluid to rotate when ejected from the nozzles, and causes the cleaning fluid to impact the walls of the wellbore at an angle.

11 Claims, 4 Drawing Sheets

SELF-EXTENDABLE HYDRAULIC WELLBORE CLEANING TOOL

TECHNICAL FIELD

The present application relates to a wellbore cleaning tool. Specifically, the present application relates to a wellbore cleaning tool with extendable nozzles and/or flow guides.

BACKGROUND

During a wellbore drilling operation, drilling fluid or drilling mud is often used to flush out drilling cuttings and debris from the wellbore. The liquid part of the drilling mud typically passes through the walls of the wellbore and gets absorbed by the surrounding formation. However, the solid parts generally do not penetrate into the formation. Thus, the solid parts of drilling mud form a layer of residue, called filter cake, on the walls of the wellbore. Thus, after a drilling operation, filter cake remains in the wellbore. Typically, a wellbore will be cased with cement during well completion. The cement is formed against the walls of the wellbore. However, filter cake, if left on the walls of the wellbore, acts as an unstable barrier between the cement and the wellbore, and prevents the cement from being robustly attached to the wellbore. This may introduce instability to the wellbore. Thus, after certain drilling operations, filter cake needs to be removed from the wellbore through a cleaning operation using a wellbore cleaning tool.

To remove filter cake, a wellbore cleaning tool is lowered downhole into the wellbore and sprays a pressurized cleaning fluid onto the walls of the wellbore. The pressurized cleaning fluid impacts the filter cake with high enough momentum to break up the filter cake and remove it from the walls. The filter cake is then flushed out. Typically, the cleaning fluid is ejected from the cleaning tool via a series of ejection points on the cleaning tool. However, conventional cleaning tools are standardized in size with fixed ejection points. Thus, when the cleaning tool is used in a wellbore having a larger diameter or irregular shape, the distance between the wellbore walls and the cleaning fluid ejection points increases, or varies. Thus, the momentum with which the cleaning fluid impacts the filter cake decreases. This may result in more cleaning fluid used, longer operation time, and overall lowered efficiency and increased cost.

SUMMARY

In general, in one aspect, the disclosure relates to a hydraulic well cleaning tool. The tool includes a tool body comprising a wall enclosing an inner chamber of the tool body, in which the wall comprises an inner surface and an outer surface, the inner surface defining the inner chamber. The tool further includes at least one extendable nozzle coupled to the wall and providing fluid communication between the inner chamber and an outside environment. The at least one extendable nozzle is extendable from a retracted position to an extended position, wherein the extendable nozzle is within the wall or at a first distance from the wall in the retracted position and at a second distance away from the wall in the extended position.

In another aspect, the disclosure can generally relate to a hydraulic well cleaning tool. The tool includes a tool body comprising a wall enclosing an inner chamber of the tool body, the wall comprising an inner surface and an outer surface, the inner surface defining the inner chamber. The tool further includes at least one nozzle coupled to the wall and providing fluid communication between the inner chamber and an outside environment in a direction of flow. The tool also includes at least one flow guide coupled to the outer surface, at least a portion of the flow guide traversing the direction of flow.

In another aspect, the disclosure can generally relate to a well cleaning tool. The tool includes a tool body comprising a wall enclosing an inner chamber of the tool body, the wall comprising an inner surface and an outer surface, the inner surface defining the inner chamber. The tool further includes at least one extendable nozzle coupled to the wall and providing fluid communication between the inner chamber and an outside environment, wherein the at least one extendable nozzle is extendable from a retracted position to an extended position, wherein the extendable nozzle is within the wall or at a first distance from the wall in the retracted position and at a second distance away from the wall in the extended position. The tool also includes at least one flow guide coupled to the outer surface, the flow guide movable between a closed position and an open position, wherein the at least one flow guide covers the at least one extendable nozzle in the closed position and hinges away from the tool body in the open position.

These and other aspects, objects, features, and embodiments will be apparent from the following description and the appended claims.

BRIEF DESCRIPTION OF THE DRAWINGS

The drawings illustrate only example embodiments of the present disclosure, and are therefore not to be considered limiting of its scope, as the disclosures herein may admit to other equally effective embodiments. The elements and features shown in the drawings are not necessarily to scale, emphasis instead being placed upon clearly illustrating the principles of the example embodiments. Additionally, certain dimensions or positioning may be exaggerated to help visually convey such principles. In the drawings, reference numerals designate like or corresponding, but not necessarily identical, elements. In one or more embodiments, one or more of the features shown in each of the figures may be omitted, added, repeated, and/or substituted. Accordingly, embodiments of the present disclosure should not be limited to the specific arrangements of components shown in these figures.

DETAILED DESCRIPTION OF EXAMPLE EMBODIMENTS

Figure 1:
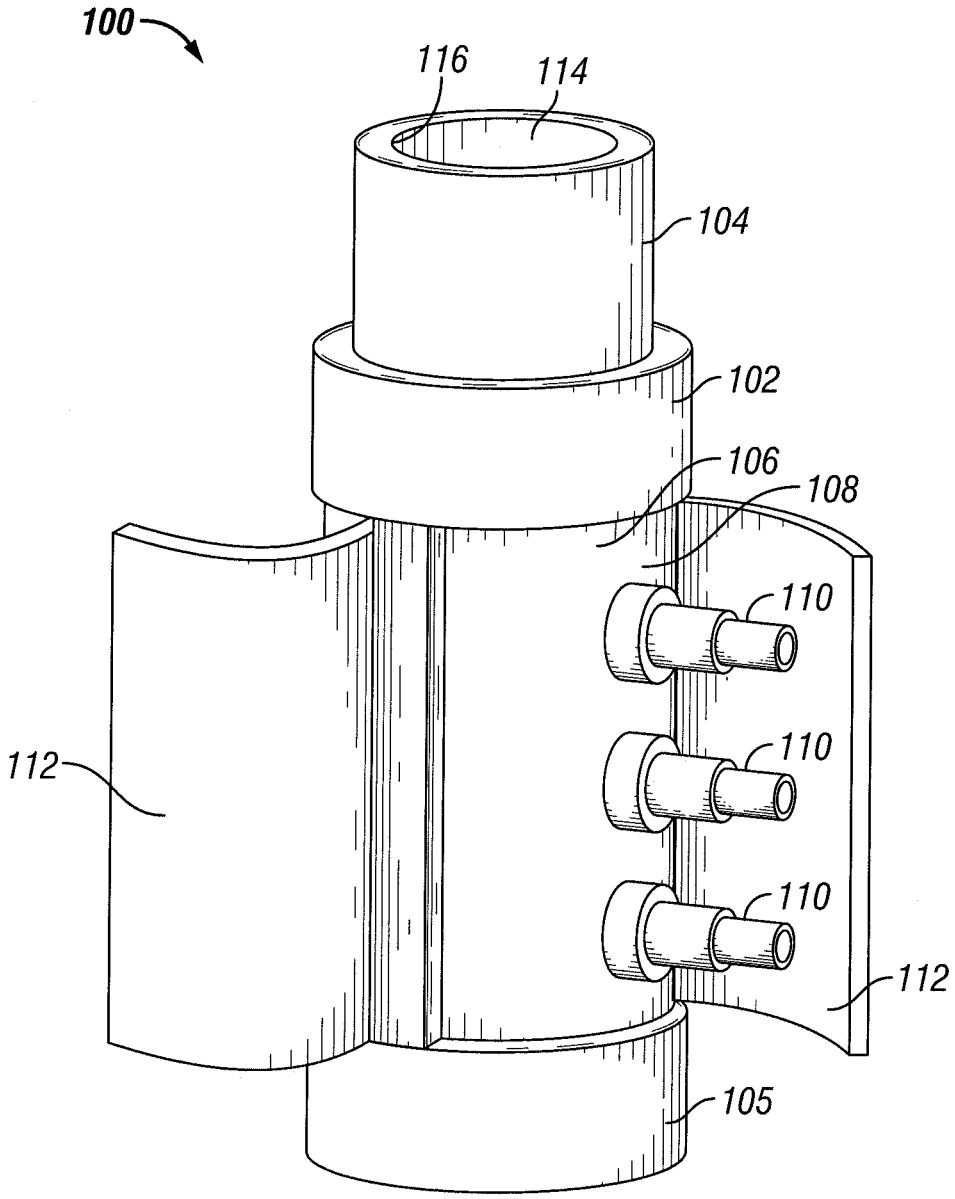
FIG. 1 illustrates a perspective view of a cleaning tool, in accordance with example embodiments of the present disclosure.

Example embodiments directed to a self-extendable hydraulic wellbore cleaning tool, hereinafter "cleaning tool" will now be described in detail with reference to the accompanying figures. Like, but not necessarily the same or identical, elements in the various figures are denoted by like reference numerals for consistency. In the following detailed description of the example embodiments, numerous specific details are set forth in order to provide a more thorough understanding of the disclosure herein. However, it will be apparent to one of ordinary skill in the art that the example embodiments disclosed herein may be practiced without these specific details. In other instances, well-known features have not been described in detail to avoid unnecessarily complicating the description. Descriptions such as "top", "above", "bottom", "below", "distal", "proximal", and the like are merely used to distinguish between different portions of an element or relative positioning between elements and are not meant to imply an absolute orientation.

Example embodiments of the present disclosure refer to using the cleaning tool to clean residue, mud cake, or the like from the walls of a borehole. This is merely one example application of the cleaning tool and is used to give context to the description of the cleaning tool, and not to limit the application or usefulness of the cleaning tool. In certain example embodiments, the cleaning tool can be used to clean a casing or production tubing, unplug a sand screen, or any other related process.

Referring now to the drawings, FIG. 1 illustrates a perspective view of a cleaning tool 100, in accordance with example embodiments of the present disclosure. In certain example embodiments, the cleaning tool 100 includes a tool body 102 having an upper end 104 and a distal end 105. The upper end 104 is configured to couple the cleaning tool 100 to a pipe (not shown) through which cleaning fluid is delivered to the cleaning tool 100. The tool body 102 includes one or more walls 106 which enclose an inner chamber 114 of the cleaning tool 100. In certain example embodiments, the tool body 102 includes a cylindrically shaped wall 106 enclosing and defining the inner chamber 114. In certain other example embodiments, the tool body 102 may include a plurality of straight walls 106 which enclose and define the inner chamber 114. The wall 106 includes an outer surface 108 and an inner surface 116, the inner surface 116 substantially defining the inner chamber 114. In certain example embodiments, the inner chamber 114 extends through the upper end 104 such that cleaning fluid can be delivered from the pipe into the inner chamber 114. In a preferred embodiment, the distal end 115 is open. In certain example embodiments, the inner chamber 114 is closed off at the distal end 105 such that the cleaning fluid in retained within the inner chamber 114.

In certain example embodiments, the cleaning tool 100 includes one or more nozzles 110 disposed within the wall 106 and configured to provide pressurized fluid communication between the inner chamber 114 and an environment outside the cleaning tool 100, such as a wellbore. In certain example embodiments, the nozzle 110 is an extendable nozzle configured to extend from the wall 106 to a certain distance away from the wall 106, or into its fully extended position. In certain example embodiments, the nozzle 110 extends orthogonally from the wall 106. In certain example embodiments, the nozzle 110 includes a plurality of segments of decreasing size which nest within each other when the nozzle 110 is in a retracted position, and which extend sequentially when the nozzle 110 is put into an extended position. In certain example embodiments, a plurality of nozzles 110 are similarly disposed in the wall 106. For example, in one embodiment, a plurality of nozzles 110 can be configured in a line down the tool body 102, as illustrated in FIG. 1. Additionally, there can be several lines of nozzles 110 disposed around the tool body 102. In certain other example embodiments, the nozzles 110 are disposed in other patterns around the tool body 102. In certain example embodiments, the nozzle 110 has only one segment which extends out of the wall 106. In certain example embodiments, the nozzle 110 does not extend out of the wall 106.

In certain example embodiments, the extendable nozzles 110 are in the retracted position by default. In certain example embodiments, the nozzles 110 are held in the retracted position by a spring mechanism, in which the neutral position or potential energy of the spring mechanism urges and holds the nozzle 110 in the retracted position. In certain example embodiments, another mechanism, such as but not limited to a actuator, holds the nozzle 110 in the retracted position as the default position of the nozzle 110 and opposes extension of the nozzle 110. In certain example embodiments, the nozzles 110 extend out when pressure within the inner chamber 114 is high enough to overcome forces opposing extension of the nozzles 110. For example, in certain embodiments, the nozzles 110 extend out when pressure within the inner chamber 114 is high enough such that the outward force applied onto nozzles 110 by the pressure overcomes the spring force holding the nozzles 110 in the retracted position. In certain example embodiments, pressure within the inner chamber 114 is created by the injection and build-up of cleaning fluid into the inner chamber 114. Thus, as cleaning fluid fills the inner chamber 114 and pressure increases, the cleaning fluid is ejected from the nozzles 110 out of the inner chamber 114, forming one or more jet streams. In certain example embodiments, the jet streams of cleaning fluid ejected from the nozzles 110 impact the walls of the borehole with enough momentum to break up and remove residue, thereby cleaning the walls of the borehole. The extension of the nozzles 110 brings the origin of the jet streams closer to the walls of the borehole, which increases the momentum with which the jet streams impact the residue, thereby increasing cleaning effectiveness.

In certain example embodiments, the cleaning tool 100 includes one or more flow guides 112. In certain example embodiments, the flow guides 112 are fin-like structures attached to the outer surface 108 of the wall 106 of the tool body 102 by an edge. In certain example embodiments, the flow guides 112 are hingedly attached to the outer surface 108 such that the flow guide 112 can pivot between a closed position and an open position. In the closed position, the flow guides 112 lay against the outer surface 108 of the wall 106 and cover the retracted nozzles 110. In the open position, the flow guides 112 pivot and extend away from the tool body 102. In certain example embodiments, the flow guides 112 are pushed open by the nozzles 110 when the nozzles 110 extend outward from the wall 106. In certain example embodiments, the flow guides 112 are held in the closed position by a spring mechanism until pushed open by the extending nozzles 110. In certain such embodiments, the extending force of the nozzles 110 overcomes the spring force of the spring mechanism holding the flow guides 112 in the closed position. In certain other embodiments, the flow guides 112 are opened and closed by a controlled actuator. In certain example embodiments, the flow guides 112 have a curved profile, as illustrated in FIG. 1. In some embodiments, the flow guides 112 compliment the curve of the tool body 102. In certain other embodiments, the flow guides 112 are straight or otherwise accommodate the shape of the tool body 102. In certain example embodiments, the wall 106 of the tool body 102 includes a recessed portion configured to receive the flow guides 112 in the closed position such that the flow guides 112 are flush with the tool body 102 in the closed position. In certain example embodiments, the flow guides 112 are fabricated from a metal material.

Figure 4:
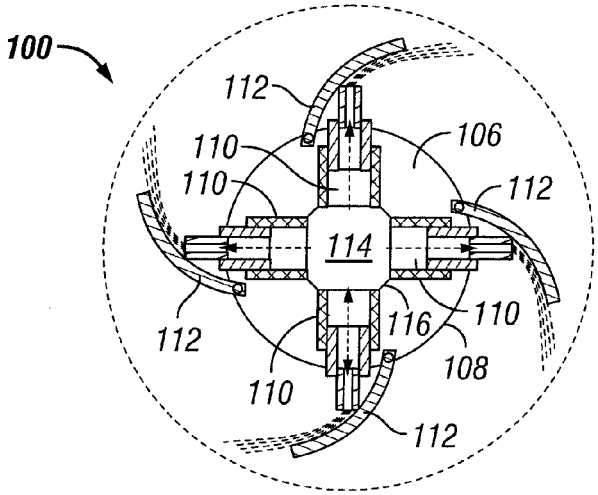
FIG. 4 illustrates a horizontal cross-sectional view of the cleaning tool in the extended position, in accordance with example embodiments of the present disclosure.

When the flow guides 112 are in the open position, the flow guides 112 traverse the trajectory of the jet streams ejected from the nozzles 110, and divert the jet streams from having a trajectory orthogonal to the tool body 102 to having an angled trajectory, as illustrated in FIG. 4. In certain example embodiments, the flow guides 112 cause the jet streams to divert and hit the walls of the borehole at an angle. In certain example embodiments, if the cleaning tool 100 is not fully centered in the borehole or if the borehole is not evenly shaped, rotation of the jet streams can even out the flow, compensating for the offset and delivering even cleaning. In certain example embodiments, the cleaning tool 100 includes the flow guides 112 and conventional non-extending nozzles. In certain other example embodiments, the cleaning tool 100 includes the extending nozzles 110 without the flow guides 112. In certain example embodiments, the cleaning tool 100 includes a mix of extending and non-extending nozzles. In certain example embodiments, the cleaning tool 100 includes one or more flow guides 112 of various shapes. In certain example embodiments, the cleaning tool 100 includes one or more nozzles whose trajectories are diverted by a flow guide 112, and one or more nozzles whose trajectories are not diverted by a flow guide 112.

Figure 2:
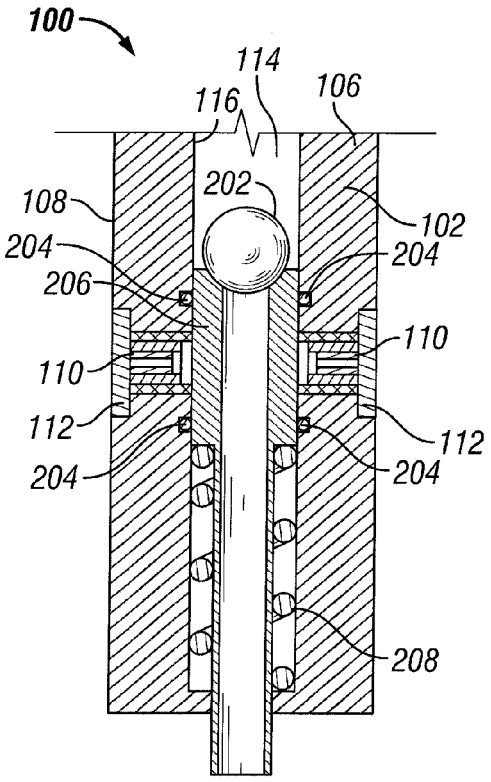
FIG. 2 illustrates a vertical cross-sectional view of a cleaning tool in a retracted position, in accordance with example embodiments of the present disclosure.

FIG. 2 illustrates a cross-sectional view of the cleaning tool 100 in a retracted position, in accordance with example embodiments of the present disclosure. Specifically, FIG. 2 illustrates a vertical cross-sectional view of the cleaning tool 100 with the nozzles 110 in the retracted position and the flow guides 112 in closed position. The nozzles 110, when retracted, are nested within the wall 106 of the cleaning tool 100 and the flow guides 112 are closed against the wall 106. In certain example embodiments, the cleaning tool 100 further includes a flow barrier 202, which is preferably, but not limited to, a ball shape, a nozzle sleeve 206, one or more seals 204, and a spring 208. The spring 208 is disposed within the inner chamber 114 at the distal end 105 of the cleaning tool 100. The nozzle sleeve 206 is disposed within the inner chamber 114 and on top of the spring 208. The nozzle sleeve 206 can move up and down as the spring 208 is compressed or decompressed. When the spring 208 is in its neutral or decompressed position, the nozzle sleeve 206 is positioned against the nozzles 110, thereby closing the inner chamber 114 off from the nozzles 110. When the nozzle sleeve 206 is pushed downward, and the spring 208 is compressed, the nozzle sleeve 206 moves past the nozzles 110, revealing the nozzles. Thus, the inner chamber 114 is put in fluid communication with the nozzles 110. In certain example embodiments, the nozzle sleeve 206 is a cylindrical structure having an outer diameter substantially the same as an the diameter of the inner surface 116 of the wall 106 of the tool body 102 such that there is minimal to no space between the nozzle sleeve 206 and the inner surface 116 of the wall 106. In certain example embodiments, the one or more seals 204 are disposed between the inner surface 116 of the wall 106 and the nozzle sleeve 206, further sealing the nozzles 110 from the inner chamber 114 when the nozzle sleeve 206 is up. In certain example embodiments, the flow barrier 202 is disposed on top of the nozzle sleeve 206, sealing the nozzle sleeve 206, and subsequently compresses the spring 208 to initiate fluid communication between the high pressure fluid in the inner chamber 114 and the nozzles 110.

Figure 3:
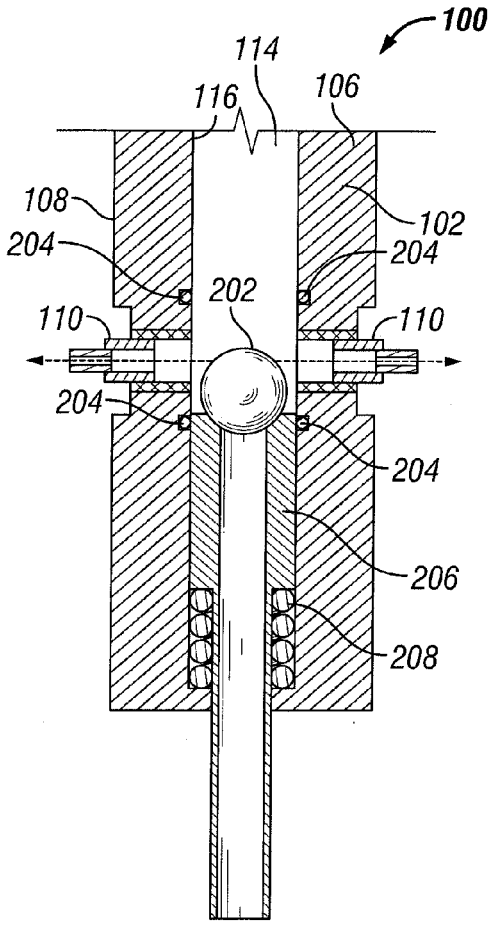
FIG. 3 illustrates a vertical cross-sectional view of the cleaning tool in an extended position, in accordance with example embodiments of the present disclosure.

FIG. 3 illustrates a vertical cross-sectional view of the cleaning tool 100 in an extended position, in accordance with example embodiments of the present disclosure. FIG. 4 illustrates a top-down cross-sectional view of the tool body 102 in the extended position, in accordance with example embodiments of the present disclosure. Referring to FIGS. 3 and 4, the cleaning tool 100 is said to be in the extended position when the nozzles 110 are extended and/or the flow guides 112 are open. In certain example embodiments, the cleaning tool 100 is put into the extended position when cleaning fluid is injected into the inner chamber 114 with enough pressure to push the flow barrier 202 and nozzle sleeve 206 down, compressing the spring 208. When the nozzle sleeve 206 is pushed past the nozzles 110, the cleaning fluid pushes the nozzles 110 outward, into the extend position, and is ejected out of the cleaning tool 100 via the nozzles 110. In certain example embodiments, during the cleaning operation, the cleaning fluid is consistently delivered into the inner chamber 114 of the cleaning tool 100 with high enough pressure to keep the nozzle sleeve 206 lowered while the cleaning fluid is ejected out from the inner chamber 114 through the nozzles 110. This means that the total force of the cleaning fluid applied on the flow barrier 202 and nozzle sleeve 206 must overcome the force of the spring 208 pushing up on the nozzle sleeve 206. In certain example embodiments, when the nozzles 110 are pushed outward by the fluid, the nozzles 110 push the flow guide out and into the open position. Thus, the cleaning fluid ejected from the nozzles is diverted by the flow guides 112 and hits the borehole at an angle. In certain example embodiments, lowering and raising of the flow barrier 202 and nozzle sleeve 206 is controlled by an actuator rather than relying on pressure from the injection of the cleaning fluid. In certain example embodiments, the flow barrier 202 is integrated with the nozzle sleeve 206 and/or is replaced by a cap or the like.

Figure 5A:
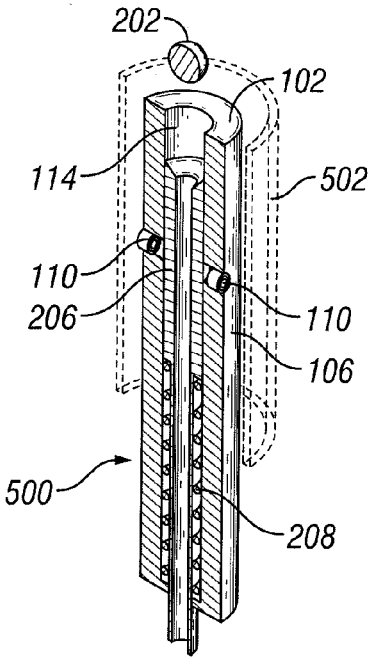
FIG. 5A illustrates a cross-sectional view of a cleaning tool with extendable nozzles in a retracted position, in accordance with example embodiments of the present disclosure.
Figure 5B:
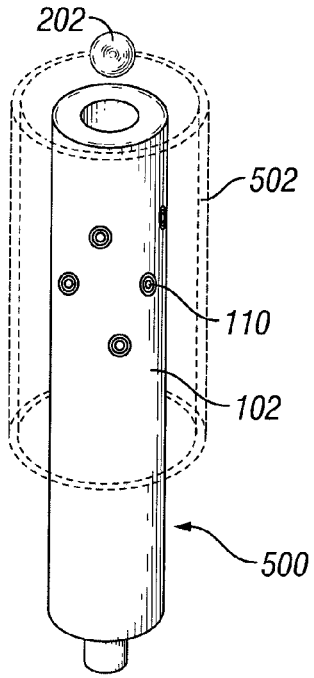
FIG. 5B illustrates a perspective view of the cleaning tool of FIG. 5A in the retracted position, in accordance with example embodiments of the present disclosure.

FIG. 5A illustrates a cross-sectional view of a cleaning tool 500 with extendable nozzles 110 in a retracted position, in accordance with example embodiments of the present disclosure. FIG. 5B illustrates a perspective view of the cleaning tool 500 of FIG. 5A, in accordance with example embodiments of the present disclosure. Referring to FIGS. 5A and 5B, the tool body 102 is disposed within a borehole 502. When the cleaning tool 500 is in the retracted position, the spring 208 is in its neutral and decompressed state and the nozzle sleeve 206 is positioned against the nozzles 110. Thus, the nozzles 110 are blocked from the inner chamber 114 and are retracted within the wall 106 of the tool body 102. In certain example embodiments, the cleaning tool 500 is in this retracted position by default, e.g., when there is no cleaning fluid being pumped into the cleaning tool 500. In certain example embodiments, the cleaning tool 500 does not include the flow guides 112 shown in FIG. 1. In certain other example embodiments, the cleaning tool 500 does include the flow guides 112.

Figure 6A:
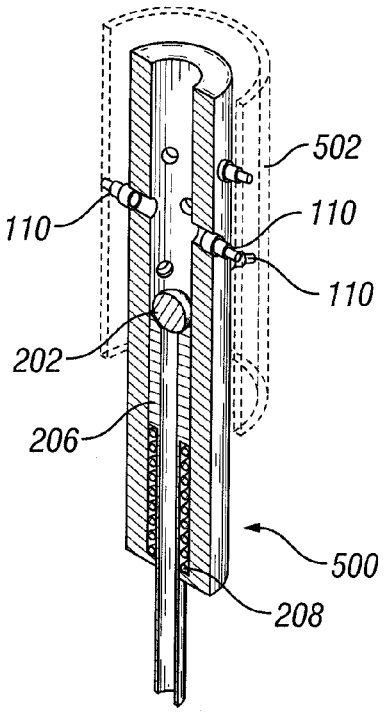
FIG. 6A illustrates a cross-sectional view of the cleaning tool of FIG. 5A in an extended position, in accordance with example embodiments of the present disclosure.
Figure 6B:
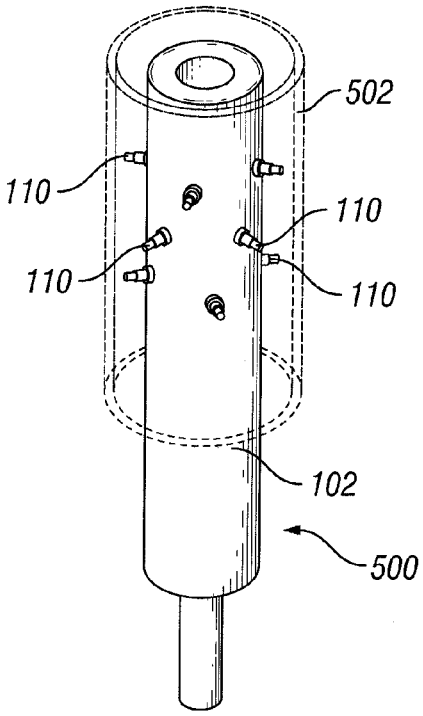
FIG. 6B illustrates a perspective view of the cleaning tool of FIG. 6A in the extended position, in accordance with example embodiments of the present disclosure.

FIG. 6A illustrates a cross-sectional view of the cleaning tool 500 in an extended position, in accordance with example embodiments of the present disclosure. FIG. 6B illustrates a perspective view of the cleaning tool 500 in the extended position, in accordance with example embodiments of the present disclosure. Referring to FIGS. 6A and 6B, the flow barrier 202 is disposed within the inner chamber 114 and sits on top of the nozzle sleeve 206, thereby isolating the inner chamber 114. As fluid is injected into the inner chamber 114, the increase in pressure in the inner chamber 114 pushes the flow barrier 202 and nozzle sleeve 206 downward, compressing the spring 208. As the nozzle sleeve 206 moves below the nozzles 110, as shown in FIG. 6A, the inner chamber 114 is in fluid communication with the nozzles 110. The fluid in the inner chamber 114 pushes the nozzles 110 outward into the extended position, and the cleaning fluid is ejected out from the nozzles 110. In the extended position, the nozzles 110 are ultimately closer to the walls of the borehole 502, and therefore the cleaning fluid ejected from the nozzles impact the walls with increased force and cleaning efficiency.

In certain other example embodiments, the nozzles 110 are configured to remain in the retracted position and not extend outward when fluid is ejected. In certain example embodiments, the nozzles 110 are controlled to extend a specific amount, in between the fully refracted position and the fully extended position. The amount of nozzle extension can be controlled based on the size of the borehole to be cleaned. In certain example embodiments, and as illustrated in FIGS. 5B and 6B, the cleaning tool 500 includes a plurality of nozzles 110 arranged in a pattern about the tool body 102. In certain example embodiments, the cleaning tool 100 may have any number of nozzles 110 and/or the nozzles 110 may be arranged in any pattern or randomly. In certain example embodiments, a subset of the total nozzles 110 on the cleaning tool is configured to extend during a cleaning operation. In certain example embodiments, the cleaning tool 500 includes nozzles 110 of different sizes and extension lengths, and all or a subset can be used to eject cleaning fluid during a cleaning operation.

Figure 7A:
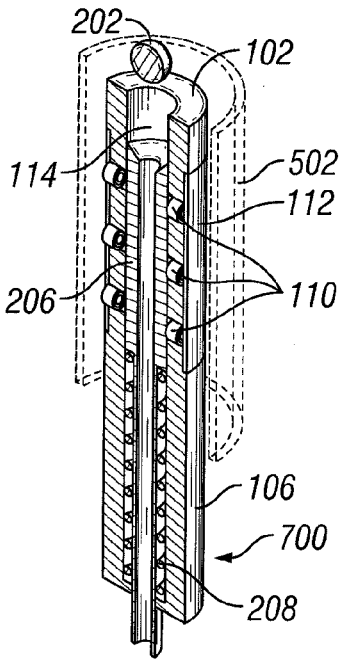
FIG. 7A illustrates a cross-sectional view of a cleaning tool with extendable nozzles and flow guides in a retracted position, in accordance with example embodiments of the present disclosure.
Figure 7B:
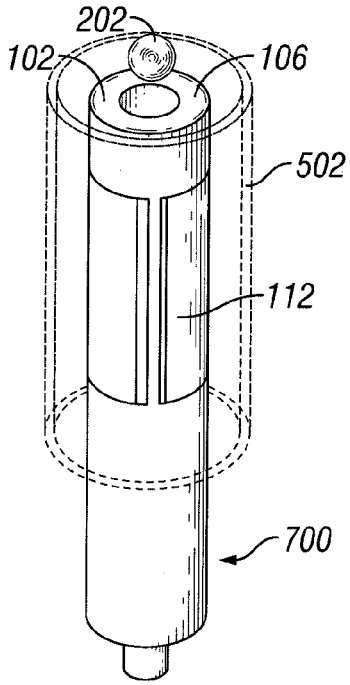
FIG. 7B illustrates a perspective view of the cleaning tool of FIG. 7A in the retracted position, in accordance with example embodiments of the present disclosure.

FIGS. 7A and 7B illustrate a cleaning tool 700 with extendable nozzles 110 and flow guides 112, in a retracted position, in accordance with example embodiments of the present disclosure. FIG. 7A illustrates a cross-sectional view of the cleaning tool 700 and FIG. 7B illustrates a perspective view of the cleaning tool 700. Referring to FIGS. 7A and 7B, when the cleaning tool 700 is in the retracted position, the spring 208 is in its neutral and decompressed state and the nozzle sleeve 206 is positioned against the nozzles 110. Thus, the nozzles 110 are blocked from the inner chamber 114 and retracted within the wall 106 of the tool body 102. Likewise, when the cleaning tool 700 is in the retracted position, the flow guides 112 are in the closed position, as illustrated in FIG. 7B. The cleaning tool 700 is generally in this retracted position by default, e.g., when there is no cleaning fluid being pumped into the cleaning tool 700.

Figure 8A:
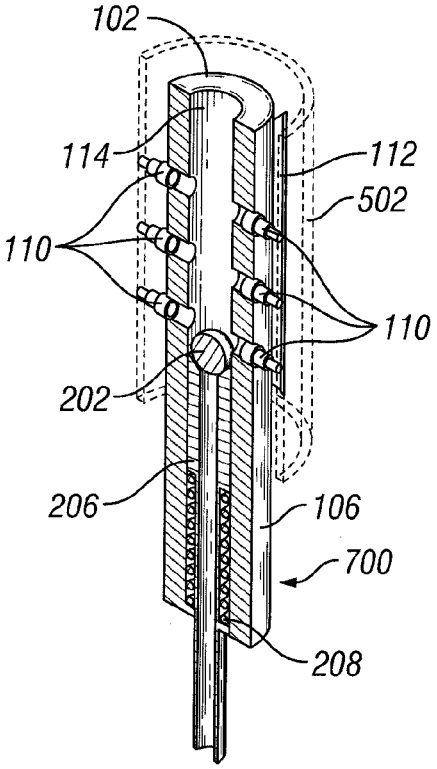
FIG. 8A illustrates a cross-sectional view of the cleaning tool of FIG. 7A in an extended position, in accordance with example embodiments of the present disclosure.
Figure 8B:
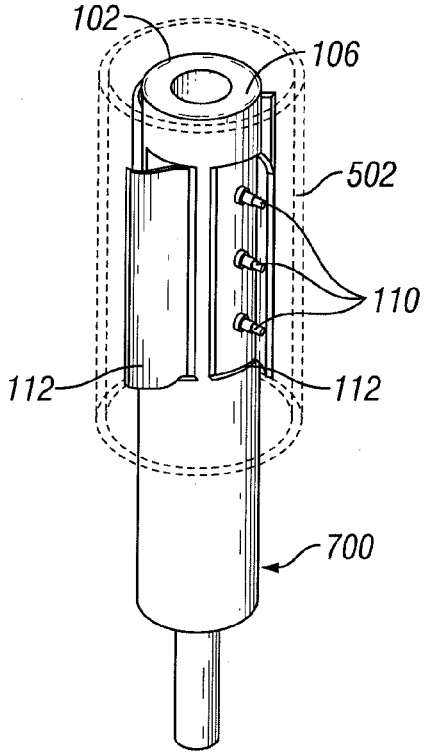
FIG. 8B illustrates a perspective view of the cleaning tool of FIG. 8A in the extended position, in accordance with example embodiments of the present disclosure.

FIGS. 8A and 8B illustrate the cleaning tool 700 in an extended position, in accordance with example embodiments of the present disclosure. FIG. 8A illustrates a cross-sectional view of the cleaning tool 700 and FIG. 8B illustrates a perspective view of the cleaning tool 700. Referring to FIGS. 8A and 8B, the flow barrier 202 is disposed within the inner chamber 114 and sits on top of the nozzle sleeve 206, thereby isolating the inner chamber 114. As cleaning fluid is injected into the inner chamber 114, the increase in pressure in the inner chamber 114 pushes the flow barrier 202 and nozzle sleeve 206 downward, compressing the spring 208. As the nozzle sleeve 206 moves below the nozzles 110, as shown in FIG. 8A, the inner chamber 114 is in fluid communication with the nozzles 110. The cleaning fluid in the inner chamber 114 pushes the nozzles 110 outward into the extended position, and the fluid is ejected out from the nozzles 110. When the nozzles 110 extend outwardly, the nozzles 110 push open the flow guides 112. In the extended position, the nozzles 110 are ultimately closer to the walls of the borehole 502 and the flow guides 112 are open. Therefore, the cleaning fluid ejected from the nozzles 110 impacts the walls of the borehole with increased force and at an angle, improving the cleaning efficiency of the cleaning tool 100.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A hydraulic well cleaning tool, comprising:

a tool body comprising a wall enclosing an inner chamber of the tool body, the wall comprising an inner surface and an outer surface, the inner surface defining the inner chamber;

at least one nozzle coupled to the wall and providing fluid communication between the inner chamber and an outside environment in a direction of flow; and at least one flow guide coupled to the outer surface by hinges, wherein at least a portion of the flow guide external to the tool body traverses the direction of flow and wherein the flow guide is movable between a closed position and an open position.

2. The hydraulic well cleaning tool of claim 1, wherein the at least one nozzle is configured to deliver a cleaning fluid in a direction of flow, and where the at least one flow guide is configured to change the direction of flow.

3. The hydraulic well cleaning tool of claim 1, wherein the at least one nozzle is extendable from a retracted position to an extended position.

4. The hydraulic well cleaning tool of claim 1, wherein at least a portion of the flow guide is curved or straight.

5. The hydraulic well cleaning tool of claim 1, wherein the at least one flow guide is held in the closed position by a spring or an equivalent energy storing mechanism.

6. The hydraulic well cleaning tool of claim 1, wherein the at least one flow guide is held in the closed position by a spring mechanism until pushed open by extension of the at least one nozzle or by electric or mechanical actuation.

7. A well cleaning tool, comprising:

a tool body comprising a wall enclosing an inner chamber of the tool body, the wall comprising an inner surface and an outer surface, the inner surface defining the inner chamber;

at least one extendable nozzle coupled to the wall and providing fluid communication between the inner chamber and an outside environment in a direction of flow, wherein the at least one extendable nozzle is extendable from a retracted position to an extended position, wherein the extendable nozzle is within the wall or at a first distance from the wall in the retracted position and at a second distance away from the wall in the extended position; and at least one flow guide coupled to the outer surface, the flow guide movable between a closed position and an open position, wherein the at least one flow guide covers the at least one extendable nozzle in the closed position and hinges away from the tool body in the open position, and wherein when the at least one extendable nozzle is extended and when the flow guide is open at least a portion of the flow guide traverses the direction of flow.

8. The well cleaning tool of claim 7, wherein the at least one flow guide traverses the trajectory of the at least one extendable nozzle.

9. The well cleaning tool of claim 7, wherein the at least one flow guide comprises a curved or straight portion.

10. The well cleaning tool of claim 7, wherein the at least one extendable nozzle pushes the flow guide from the closed position into the open position when the at least one extendable nozzle extends from the retracted position to the extended position.

11. The well cleaning tool of claim 7, wherein the at least one extendable nozzle is moved into the extended position and the at least one flow guide is moved into the open position when pressure in the inner chamber reaches a certain level.

* * * * *